US008033219B2

(12) United States Patent
Pasuch et al.

(10) Patent No.: US 8,033,219 B2
(45) Date of Patent: Oct. 11, 2011

(54) APPARATUS AND METHOD FOR TREATING A ROTATING PRINTING TECHNOLOGY SURFACE WITH A PROCESS LIQUID, MACHINE FOR PROCESSING PRINTING MATERIAL AND MACHINE FOR TREATING PRINTING FORMS

(75) Inventors: Michael Pasuch, Waldorf (DE); Bernd Hoffmann, Schifferstadt (DE); Helge Grandt, Sandhausen (DE); Alexander Matern, Neulußheim (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 139 days.

(21) Appl. No.: 12/176,737

(22) Filed: Jul. 21, 2008

(65) Prior Publication Data

US 2009/0020031 A1 Jan. 22, 2009

(30) Foreign Application Priority Data

Jul. 19, 2007 (DE) ..... 10 2007 033 681

(51) Int. Cl.
*B41F 35/00* (2006.01)

(52) U.S. Cl. ..... 101/425; 101/424

(58) Field of Classification Search ..... 101/425
See application file for complete search history.

(56) References Cited

U.S. PATENT DOCUMENTS

| | | | | |
|---|---|---|---|---|
| 4,393,778 | A * | 7/1983 | Kaneko | 101/425 |
| 4,480,548 | A * | 11/1984 | Rebel et al. | 101/483 |
| 4,686,132 | A | 8/1987 | Sumii et al. | |
| 5,227,844 | A | 7/1993 | Bhattacharjee et al. | |
| 5,299,495 | A | 4/1994 | Schoeps et al. | |
| 5,379,696 | A * | 1/1995 | Boehme et al. | 101/424 |
| 5,564,338 | A | 10/1996 | Branas | |
| 5,931,096 | A | 8/1999 | Detmers et al. | |
| 6,092,938 | A * | 7/2000 | Earle et al. | 396/626 |
| 6,095,164 | A * | 8/2000 | Saitoh et al. | 134/113 |

(Continued)

FOREIGN PATENT DOCUMENTS

| | | | |
|---|---|---|---|
| DE | 91 09 721 | U1 | 10/1991 |
| DE | 44 26 012 | C2 | 1/1996 |
| DE | 695 08 152 | T2 | 7/1999 |
| DE | 199 38 414 | A1 | 2/2001 |

(Continued)

OTHER PUBLICATIONS

German Patent and Trademark Office Search Report, dated Jul. 19, 2007.

*Primary Examiner* — Anthony H. Nguyen
(74) *Attorney, Agent, or Firm* — Laurence A. Greenberg; Werner H. Stemer; Ralph E. Locher

(57) ABSTRACT

An apparatus and method for treating a rotating printing technology surface, especially a re-imageable printing form, with a process liquid, such as cleaning, covering or rinsing liquid, include jet nozzles disposed along a straight line substantially parallel to the axis of rotation of the printing technology surface, and a cloth device substantially parallel to the axis of rotation. The nozzles pivot about a pivot axis substantially perpendicular to the axis of rotation for producing a substantially uniform distribution of process liquid parallel to the axis of rotation. The cloth device preferably has a cloth with segmented or calendered portions substantially parallel to the axis of rotation, for substantially limiting spread of process liquid in the cloth parallel to the feed direction of the cloth and assisting substantially uniform distribution of process liquid parallel to the axis of rotation. Machines for processing printing material and for treating printing forms are also provided.

16 Claims, 5 Drawing Sheets

U.S. PATENT DOCUMENTS

| | | | | |
|---|---|---|---|---|
| 6,125,756 | A | 10/2000 | Nussel et al. | |
| 6,637,335 | B2 | 10/2003 | Jentzsch | |
| 6,748,864 | B2 * | 6/2004 | Verschueren et al. | 101/463.1 |
| 2002/0139268 | A1 * | 10/2002 | Emery et al. | 101/425 |
| 2005/0223926 | A1 * | 10/2005 | Baeten | 101/425 |
| 2006/0137553 | A1 * | 6/2006 | Corti et al. | 101/425 |

FOREIGN PATENT DOCUMENTS

| | | | |
|---|---|---|---|
| DE | 100 32 703 | A1 | 1/2002 |
| DE | 203 17 975 | U1 | 4/2004 |
| DE | 196 27 748 | B4 | 4/2006 |
| DE | 10 2005 042 999 | A1 | 3/2007 |
| EP | 0 687 563 | A2 | 12/1995 |

* cited by examiner

APPARATUS AND METHOD FOR TREATING A ROTATING PRINTING TECHNOLOGY SURFACE WITH A PROCESS LIQUID, MACHINE FOR PROCESSING PRINTING MATERIAL AND MACHINE FOR TREATING PRINTING FORMS

CROSS-REFERENCE TO RELATED APPLICATION

This application claims the priority, under 35 U.S.C. §119, of German Patent Applications DE 10 2007 033 681.2, filed Jul. 19, 2007 and DE 10 2007 038 141.9, filed Aug. 13, 2007; the prior applications are herewith incorporated by reference in their entirety.

BACKGROUND OF THE INVENTION

Field of the Invention

The present invention relates to an apparatus for treating a rotating printing technology surface with a process liquid, having a plurality of nozzles which are disposed along a straight line substantially parallel to the axis of rotation of the printing technology surface in such a way that they can pivot, and a cloth device which is disposed substantially parallel to the axis of rotation. Furthermore, the present invention relates to a method for treating a rotating printing technology surface with a process liquid, wherein the process liquid is discharged by a plurality of nozzles which are disposed along a straight line substantially parallel to the axis of rotation of the printing technology surface in such a way that they can pivot, and the process liquid is at least partly picked up by a cloth of a cloth device which is disposed substantially parallel to the axis of rotation. Additionally, the present invention relates to a method for treating a rotating printing technology surface with a process liquid, wherein the process liquid is discharged by a plurality of nozzles which are disposed along a straight line substantially parallel to the axis of rotation of the printing technology surface in such a way that they can pivot, and the process liquid is at least partly picked up by a cloth of a cloth device which can be moved in a feed direction and is disposed substantially parallel to the axis of rotation. The present invention also relates to a machine for processing printing material and a machine for treating printing forms.

It is already known from the prior art to use printing forms that can be imaged and in particular re-imaged in printing presses, for example in sheet-processing rotary printing presses. The imaging process or re-imaging process normally includes a number of process steps, such as washing, erasing, coating or covering, imaging and developing. In some of those process steps, process liquids have to be applied to the surface of the printing form to be imaged or else excess liquid has to be picked up again from the surfaces. Examples thereof are the application of cleaning liquid, the picking up of cleaning liquid and printing ink, the application of a coating/covering medium and/or a developing medium as well as the application and removal of a rinsing liquid. Furthermore, it is also already known to carry out the application of process liquids through the use of spray nozzles and to pick up process liquids and ink or contaminants through the use of a cloth.

For instance, German Patent DE 44 26 012 C2, corresponding to U.S. Pat. No. 6,125,756, U.S. Pat. No. 5,816,161 and U.S. Pat. No. 6,016,750, describes an erasable printing form, its use and methods for erasing and regenerating the printing form, in which use is made of preferably adjustable-angle nozzles 14, that spray on various agents, such as cleaning liquid or hydrophilicizing agents, for example, either directly onto a printing form 2 or onto a cleaning cloth 8. Since the nozzles permit spraying both directly onto the printing form and onto a cleaning cloth, the pivot axis of the nozzles is disposed parallel to the axis of rotation of a form cylinder 1 carrying the printing form. Since a spray mist is produced by the spray nozzle, it is necessary to provide the cloth device or cleaning apparatus with a housing which prevents uncontrolled spread of the spray mist. Furthermore, the use of spray nozzles can lead to the agent to be applied not being deposited exactly at the point of the printing form or cloth at which it is intended to be applied, or to the desired quantity of the agent not being deposited on the printing form or the cloth.

German Utility Model DE 203 17 975 U1 likewise discloses cleaning nozzles 26 which are disposed in such a way as to be distributed over an axial length of a press roll, and with which a cleaning agent can be sprayed onto a press roll to be cleaned. That apparatus can also have the disadvantage that the spray mist is deposited at undesired points or in an undesired distribution. Furthermore, an ability to pivot the cleaning nozzles is not disclosed.

German Translation DE 695 08 152 T2 of European Patent EP 0 687 563 B1 corresponding to U.S. Pat. No. 5,564,338 also discloses an apparatus for washing the inking elements of a rotary printing press, which has a washing apparatus 8 with a distributor 14 equipped with four nozzles 15 to 18 and in which the distributor is disposed in such a way that it can be pivoted. The distributor together with the spray nozzles completes a to and fro movement, with the distributor being pivoted at the reversal points of the to and fro movement, so that a cleaning liquid is sprayed at two different angles during the to and fro movement. However, the nozzle 18 aimed at the surface of a roll 3 is not affected by that pivoting movement, which is to say it sprays continuously onto the surface at the same angle. Such a traversing spray apparatus can have the disadvantage, besides the above-mentioned disadvantages of spraying devices, that the desired or necessary dynamics cannot be achieved because of the components to be moved and their masses, in particular in the case of wide machines and consequently long traverse paths.

Finally, German Published, Non-Prosecuted Patent Application DE 100 32 703 A1 corresponding to U.S. Pat. No. 6,637,335 also describes a method or a device in printing presses for imaging surfaces, with a traversing device 6 having an erasing unit 61 being used. That device can also have the disadvantage that the required dynamics cannot be achieved, for example in the case of wide machines, because of the traversing movement of the device, which will once more have a detrimental effect on the respective process duration.

U.S. Pat. No. 4,686,132 discloses a toner particle cleaning cloth 1 which is pretreated (impregnated) with silicone oil and has strip-like depressions 2 running perpendicular to a feed direction of the cloth. The cloth picks up toner more intensely in the strip-like depressions, which is to say at the compressed and not at the uncompressed points. By contrast, U.S. Pat. No. 5,227,844 discloses in FIG. 3 a toner particle cleaning cloth 30 having strips 50 which are formed of a synthetic polymer material. However, in neither of the two documents is there any description of when and how the respective cloth could be used for processing various liquids.

In addition, German Published, Non-Prosecuted Patent Application DE 196 27 748 B4 corresponding to U.S. Pat. No. 5,931,096 describes a cloth for a cleaning device. The cloth is formed as a microfiber nonwoven material having calendered portions, for example circles, small rods, diamonds, triangles and forms with or without an overlap, in which the calendered portions produce a uniform wiping effect.

SUMMARY OF THE INVENTION

It is accordingly an object of the invention to provide an apparatus for treating a rotating printing technology surface with a process liquid, which overcomes the hereinafore-mentioned disadvantages of the heretofore-known apparatuses of this general type, which is improved over the prior art, which permits a uniform distribution of one process liquid or preferably a plurality of process liquids (one after another) parallel to an axis of rotation of a printing technology surface to be treated and which is able to produce the aforementioned uniform distribution in a short time and/or with high dynamics.

It is also an object of the invention to provide a method for treating a rotating printing technology surface with a process liquid, which overcomes the hereinafore-mentioned disadvantages of the heretofore-known methods of this general type, which permits a uniform distribution of one process liquid or preferably a plurality of process liquids (one after another) parallel to the axis of rotation of a rotating printing technology surface, in particular in a short time and/or with high dynamics, as well as a method which is able to reduce the costs, in particular the consumables costs for liquids and cloth or cloths during the treatment of the printing technology surface.

It is furthermore an object of the invention to provide a machine for processing printing material, for example a printing press, in particular a sheet-processing rotary printing press for lithographic offset printing or a print finishing machine, and a machine for treating printing forms, for example a printing press, in particular a sheet-processing rotary printing press for lithographic offset printing or a printing plate exposer, which overcome the hereinafore-mentioned disadvantages of the heretofore-known machines of this general type.

With the foregoing and other objects in view there is provided, in accordance with the invention, an apparatus for treating a rotating printing technology surface, preferably a re-imageable printing form held on the surface of a cylinder, with a process liquid, comprising a plurality of nozzles which are disposed along a straight line substantially parallel to the axis of rotation of the printing technology surface in such a way that they can pivot, and a cloth device which is disposed substantially parallel to the axis of rotation. The nozzles are constructed as jet nozzles, which in each case can be pivoted about a pivot axis substantially perpendicular to the axis of rotation.

The construction of the nozzles or metering elements disposed along a straight line in such a way that they can pivot as jet nozzles according to the invention as well as the alignment according to the invention of the respective pivot axes of the jet nozzles substantially perpendicular to the axis of rotation of the printing technology surface, advantageously permits the production of a substantially uniform or homogeneous distribution of the process liquid parallel to the axis of rotation. It is possible for this uniform distribution in turn to be produced advantageously quickly and in particular highly dynamically. In addition, the structure according to the invention takes up little space.

Turning away from the teaching of the prior art, according to the invention no spray nozzles producing a spray mist but instead jet nozzles producing a respective spray jet and preferably being capable of separate driving are used and, once more turning away from the teaching of the prior art, they are not pivoted about a pivot axis parallel to the axis of rotation but about a pivot axis perpendicular to the axis of rotation of the rotating printing technology surface.

In accordance with another feature of the invention, that is advantageous for the production of a uniform distribution of the process liquid, provision can be made for the nozzles, preferably spaced apart from one another, to be coordinated with one another, in particular to be pivotable with one another. To this end, the individual jet nozzles can preferably be connected to one another by one or more mechanical coupling rods.

In accordance with a further feature of the invention, which is advantageous in particular in imaging methods needing a plurality of process liquids, provision can be made for the nozzles to be disposed along the straight line in nozzle groups or nozzle packs that are preferably spaced apart from one another (and therefore disposed so as to be distributed in the axial direction). It is possible for the individual nozzles of a nozzle group to be pivoted together and to discharge various process liquids. Preferably, about 3 to about 5 nozzles are provided per group. It is further advantageous to pivot the respective nozzle groups in a manner coordinated with one another, in particular with one another, which in turn can preferably be done by one or more mechanical coupling rods.

In accordance with an added feature of the invention, which is advantageous with regard to the production of a uniform distribution of the process liquid and is therefore preferred, can be distinguished by the fact that the nozzles of a respective nozzle group are aimed substantially at the same point, which is to say that the points of impingement of the jets, for example on the surface of the printing form or of the cloth, lie close by one another, adjoin one another, overlap or are even substantially identical. In this case, the following can be provided during a pivoting movement of the nozzle group: at the center of the pivoting movement, the points of impingement lie substantially above one another and, at the edges or reversal points of the pivoting movement, they merely lie close by one another. Since, as a rule, it is always only one nozzle of the group that is active during a pivoting movement, the points of impingement as a rule cannot lie actually as described above in relation to one another but only when viewed together, if therefore a plurality of pivoting movements and thus nozzle activities are considered together. The activation of individual nozzles and the performance of the pivoting movement are carried out substantially simultaneously. At the edges or reversal points of the pivoting movement, however, it is also possible for time-offset activation and deactivation of the nozzle to be provided (turning on or turning off the nozzle earlier or later).

In accordance with an additional feature of the invention, which is likewise advantageous for the uniform distribution of the process liquid, the cloth device can have a cloth with segmented portions running substantially parallel to the axis of rotation. As a result of the provision of such segmented portions, a substantially uniform distribution of the process liquid parallel to the axis of rotation can be assisted in an advantageous way. Furthermore, the advantage results that the consumption of cloth can be reduced as a result of limited spread/creep/migration of process liquid in the cloth parallel to the feed direction of the cloth and perpendicular to the direction of the segmented portions. For instance, provision can be made to provide the segmented portions as calendered portions of the cloth running substantially parallel to the axis of rotation. This results in the advantage of a cloth that is simple to produce and cost-effective.

With the objects of the invention in view, there is also provided a machine for processing printing material, for example a printing press, in particular a sheet-processing rotary printing press for lithographic offset printing, or a print finishing machine, or a machine treating printing forms, e.g. a printing press, in particular a sheet-processing rotary printing press for lithographic offset printing, or a printing plate exposer, which are distinguished by at least one apparatus as described above with reference to the invention.

With the objects of the invention in view, there is additionally provided a method for treating a rotating printing technology surface, preferably a printing form, with a process liquid, which comprises discharging the process liquid from a plurality of nozzles which are disposed along a straight line substantially parallel to the axis of rotation of the printing technology surface in such a way that they can pivot, and at least partly picking up the process liquid with a cloth of a cloth device which is disposed substantially parallel to the axis of rotation. The jet nozzles are pivotable, and the jet nozzles are each pivoted about a pivot axis substantially perpendicular to the axis of rotation.

When the method according to the invention is carried out, the same advantages result as those which have been mentioned above with reference to the apparatus according to the invention and its developments. In particular, the possibility of producing a uniform distribution of the process liquid parallel to the axis of rotation should be mentioned once more herein, and also the further advantages of reducing the liquids consumed, as a result of the precise, targeted application and the uniform distribution of the liquids and the shortening of the process time.

With the objects of the invention in view, there is provided a method for treating a rotating printing technology surface with a process liquid, which comprises discharging the process liquid with a plurality of nozzles which are disposed along a straight line substantially parallel to the axis of rotation of the printing technology surface in such a way that they can pivot, and at least partly picking up the process liquid with a cloth of a cloth device which can be moved in a feed direction and is disposed substantially parallel to the axis of rotation. The cloth has segmented portions provided substantially parallel to the axis of rotation and, through coordinating the feed and the segmentation of the cloth, the spread of the process liquid in the cloth parallel to the feed direction is substantially limited.

The coordination of the feed and the segmentation of the cloth in this case can be carried out, for example, by coordinating a feed width and a segment width (sum of the cloth width between two segmented portions and the width of a segmented portion) with one another. The feed width can, in particular, correspond substantially to the segment width or an integer multiple n (preferably $n<10$ or $n<5$) thereof.

Carrying out this method according to the invention likewise leads to the advantages already described above (uniform distribution, reduced liquid consumption), in particular to it being possible for a uniform distribution of the process liquid parallel to the axis of rotation to be produced. However, carrying out the method according to the invention also leads to the further advantage that, as a result of the coordination of the feed and the segmentation of the cloth, the cloth consumption and consequently the (consumption) costs for the treatment method can be reduced further and process times can be shortened.

It is a particular advantage of the method according to the invention that by using a segmented cloth, the most diverse process liquids (different viscosities and surface tensions; aqueous, surfactant properties, oily) can in each case be externally metered over the saturation region of the cloth and therefore respectively homogeneous liquid films can be produced on the printing technology surface. By introducing segmented portions into the cloth it is namely possible to use a cloth with large absorption for one or more process liquids without having to accept an undesired spread of the liquid or liquids in or against the feed direction. The use of different cloths for processing the different liquids can advantageously be avoided.

In accordance with a concomitant mode of the invention, provision can be made for the process liquid to be metered into a nip between the cloth and the printing technology surface. In this way, it is possible for example for a meniscus of the process liquid to be formed in the nip between the cloth and the printing technology surface during the processing of selected process liquids which, in an advantageous way, further assists the production of a uniform distribution of the process liquid parallel to the axis of rotation and, as a result, the production of a uniform distribution of the process liquid in the circumferential direction of the printing technology surface.

The apparatus according to the invention that has been described and the methods according to the invention that have been described and also the advantageous developments of the invention that have been described also constitute advantageous developments of the invention as such in combination with one another. For example, it is advantageous to gather the nozzles together into nozzle groups and in turn to configure the nozzle groups in such a way that they can be pivoted with one another, with the nozzles of a respective nozzle group being aimed substantially at the same point. Likewise, it is advantageous to use jet nozzles that can be pivoted and a cloth having segmented portions provided substantially parallel to the axis of rotation, to pivot the jet nozzles in each case about a pivot axis substantially perpendicular to the axis of rotation and, through the use of coordinating the feed and the segmentation of the cloth, to substantially limit the spread of the process liquid in the cloth parallel to the feed direction. In this case, the pivoting is preferably carried out when the cloth is at a standstill.

Other features which are considered as characteristic for the invention are set forth in the appended claims.

Although the invention is illustrated and described herein as embodied in an apparatus and a method for treating a rotating printing technology surface with a process liquid, a machine for processing printing material and a machine for treating printing forms, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
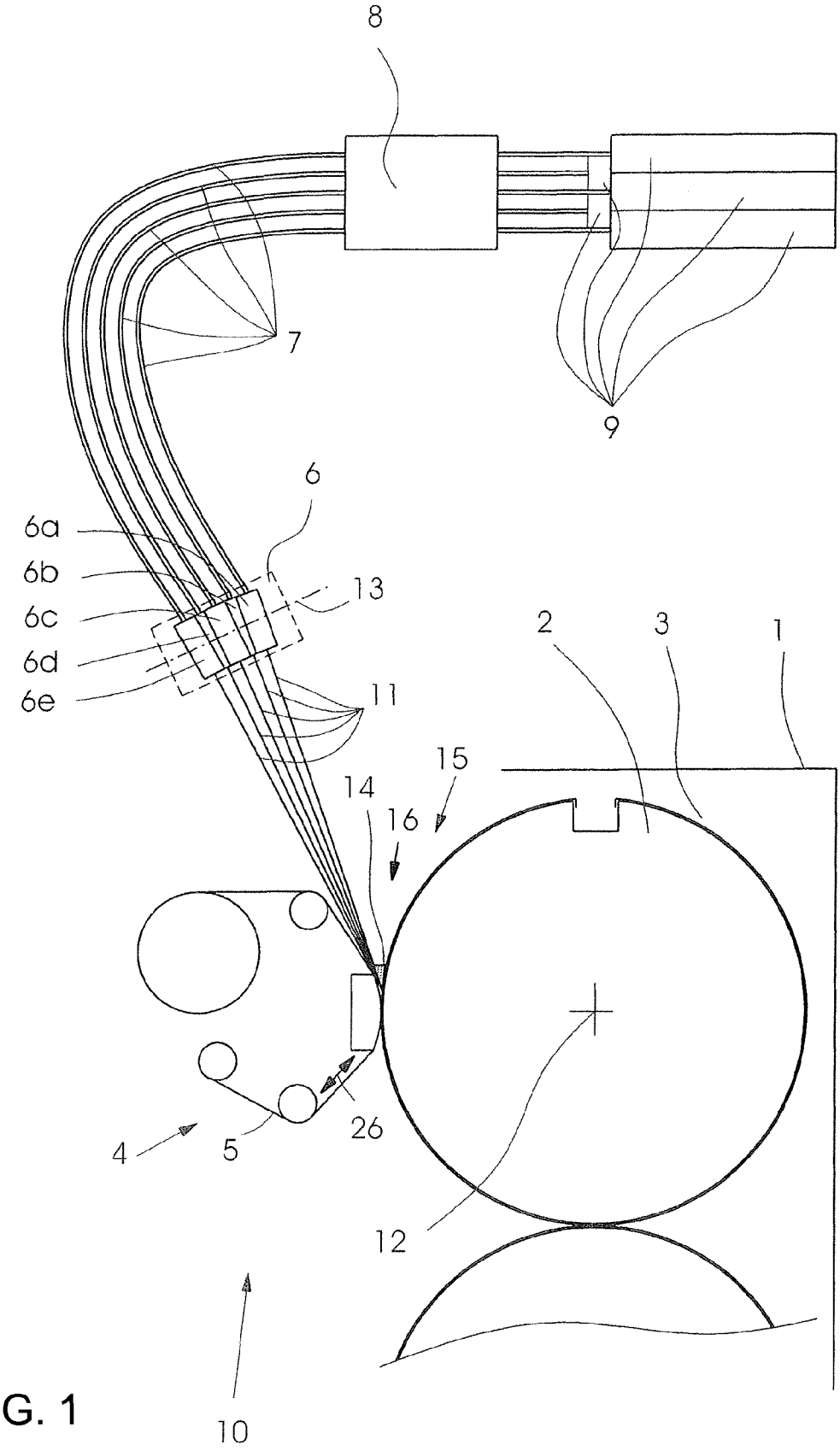
FIG. 1 is a diagrammatic, cross-sectional view of a preferred exemplary embodiment of an apparatus according to the invention.

Referring now to the figures of the drawings in detail and first, particularly, to FIG. 1 thereof, there is seen a machine 1 for processing printing material, in particular a rotary printing press processing sheets or webs for lithographic offset printing. The machine 1 has a rotatable cylinder 2 (preferably a printing form cylinder), on the circumferential surface of which a printing technology surface 3, in particular a re-imageable printing form, is accommodated and will be referred to generally in the following text as a "printing form," without being restricted thereto. Furthermore, FIG. 1 shows a cloth device 4 having a cloth 5 which can be moved forward, can be unwound and wound up and can be set against the surface of the printing form 3, in particular it can be pressed on, through the use of a pressing lip. A nozzle group or a nozzle pack 6 having, by way of example, five nozzles or metering elements 6*a* to 6*e*, is also shown. The nozzles are connected through respective supply lines 7 to a control unit 8 and respective storage containers 9.

An apparatus 10 according to the invention for treating the rotating printing form 3 with at least one process liquid 11, in this case includes the nozzles 6*a* to 6*e* and the cloth device 4. In this case, the nozzles 6*a* to 6*e* are (respectively) disposed along a straight line substantially parallel to an axis of rotation 12 of the printing form 3 in such a way that they can be pivoted (see FIG. 2), and the cloth device 4 is likewise disposed substantially parallel to the axis of rotation 12. Furthermore, the invention provides for the nozzles 6*a* to 6*e* to each be formed as jet nozzles and to be disposed in such a way that they can be pivoted about a (respective) pivot axis 13 substantially perpendicular to the axis of rotation 12. The apparatus 10 can be moved as a whole relative to the cylinder 2, in particular pivoted, in order to set it on and off. The apparatus 10 according to the invention can be used, in particular, during the processing of re-imageable printing forms 3 which are provided with a nanoscopic or molecular covering of so-called amphiphilic molecules which can be imaged by a laser (such a printing form is described in German Published, Non-Prosecuted Patent Application DE 102 27 054 A1, for example).

It can be seen in FIG. 1 that the nozzles of the nozzle group 6 are aimed substantially at the same point 14. This point 14 is located in the region of a nip or pocket 15 between the cloth 5 and the surface of the printing form 3. Thus, the process liquid or process liquids is or are metered into the nip 15. In this case, through the use of a displacement of the nozzle group 6, the point 14 can be located on the surface of the printing form 3, on the surface of the cloth 5, or in between, in the region of a meniscus of the process liquid forming in the nip 15.

As an alternative to the configuration of the apparatus 10 shown in FIG. 1, provision can also be made to provide the apparatus 10 not in a printing press 1 but in an imaging device separate from the printing press, for example in a plate exposer, together with an imaging cylinder.

Figure 2:
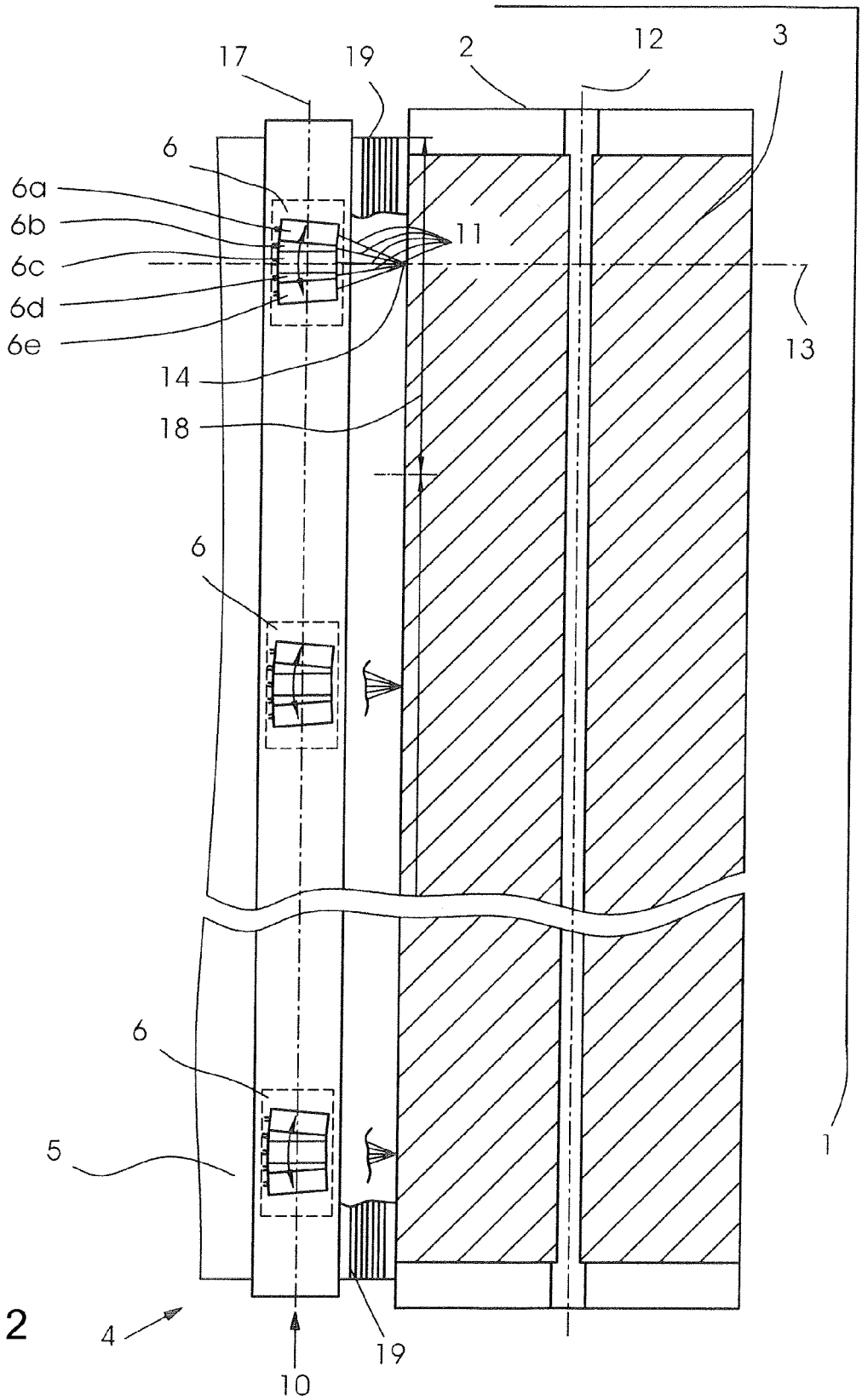
FIG. 2 is an enlarged, plan view of the preferred exemplary embodiment of the apparatus according to the invention.

In the plan view shown in FIG. 2, it can be seen that a plurality of nozzle groups 6 each having a plurality of nozzles 6*a* to 6*e* (for example five) are disposed along a straight line 17. Corresponding nozzles of the nozzle groups are also disposed along a (respective) straight line (that is, all of the nozzles 6*a* to 6*e*, etc. are disposed along on a respective straight line). In this case, the straight line 17 is disposed substantially parallel to the axis of rotation 12 of the printing form 3 and of the cylinder 2. As a result of the pivotable configuration of the nozzle groups 6 and of the respective nozzles of a nozzle group, the point 14 at which the process liquid or process liquids impinge can be varied within a region 18. The respective (pivoting) regions 18 of the respective nozzle groups 6 in this case adjoin one another or overlap in such a way that a substantially uniform application of respective process liquids over the extent of the printing form 3 in the direction of the axis of rotation 12 is made possible. The spacing of the nozzle groups 6 from one another and the possible pivoting movements of the nozzle groups 6 are chosen in such a way that the process liquid 11 of the respective regions 18 has a substantially uniform distribution parallel to the axis of rotation 12 (on the surface of the printing form 3, on the surface or in the cloth 5 or in the meniscus 16).

It can also be seen in FIG. 2 that the cloth 5 has segmented portions 19 running and formed substantially parallel to the axis of rotation 12 (see FIGS. 4 and 5). The cloth 5 can be spooled both forward and backward through the use of spooling devices, preferably motor-driven spooling devices, provided for that purpose. The term "feed" is therefore used both for the actual forward movement of the cloth and for the opposite movement. Provision can be made for the cloth to be moved back, for example, if cloth segments have picked up only a little liquid and can therefore be used a second time (at least for a rough cleaning step), so that the cloth consumption can be reduced further.

Figure 3:
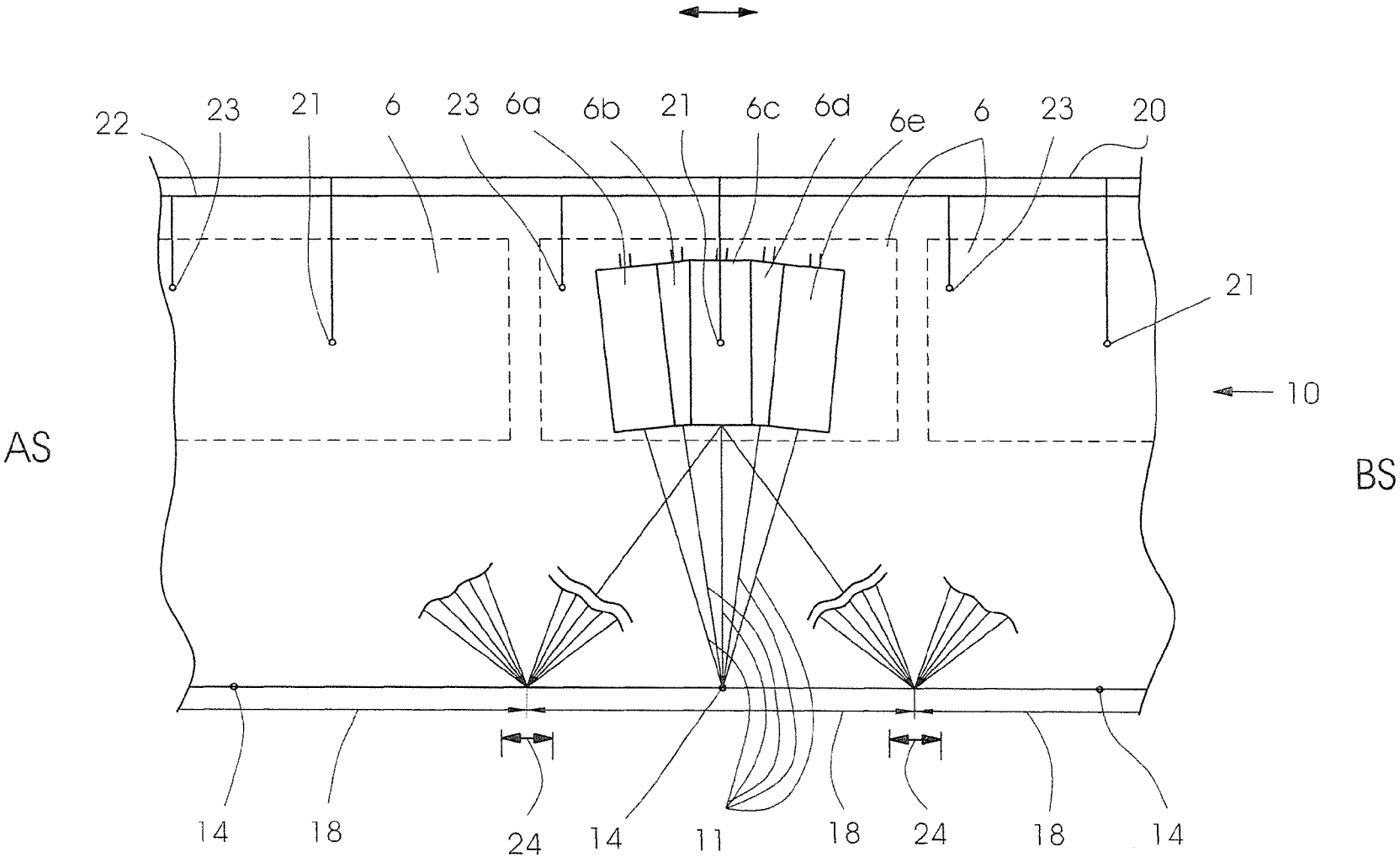
FIG. 3 is a further enlarged, fragmentary, plan view illustrating the structure and mode of action of a preferred exemplary embodiment of a nozzle pack of the apparatus according to the invention.

FIG. 3 illustrates the function of the apparatus according to the invention and the performance of the method according to the invention. The illustrated apparatus 10 has a plurality of nozzle groups 6, which in each case in turn have a plurality of nozzles, for example 6*a* to 6*e*. The nozzle groups 6 are connected to one another by mechanical coupling rods 20 and 22 and, when the mechanical coupling rods 20 and 22 are activated, can be pivoted about a respective pivot point 21 in such a way that the point of impingement 14 of the respective process liquids 11 moves substantially along a straight line (or a curve with a slight curvature). Both the speed and the angular range of the pivoting movement of the nozzles or nozzle groups can preferably be varied.

In order to form a meniscus 16 of a respective process liquid in the nip 15 between the surface of the printing form 3 and the cloth 5, the nozzle groups 6 can initially be pivoted in such a way that the point of impingement 14 is moved in a boundary region or overlap region 24 (as an example: +30°). Then, one of the nozzles of the nozzle group 6 is activated (for example by the associated valve being opened for about 150 ms) and a process liquid 11 is discharged in the form of a jet (in the desired quantity or metered amount). In this case, the nozzle group 6 is simultaneously pivoted with a substantially constant speed and the point of impingement 14 is moved and guided substantially along the region 18 to a further boundary region or overlap region 24 (as an example: −30°). The sections of the process liquid meniscus produced in this way combine over the width of the printing form 3 and form a common, continuous meniscus 16 in the region of the nip between the printing form and the cloth. In this way, it is made possible to discharge and to meter a series of different process liquids in the desired metered amount and in a uniform distribution into the nip between the printing form and the cloth.

During the metering of the process liquid and also for a specific time period thereafter, the cylinder 2 is preferably rotated. Alternatively, the rotation of the cylinder 2 can also be initiated only after the metering, so that the process liquid 11 of the meniscus 16 is distributed on the printing form as a uniform film. Then, with the nozzle device deactivated, a feed movement of the cloth and rotation of the cylinder 2 can be initiated, so that excess process liquid is removed from the printing form again. The feed movement can be carried out segment by segment, so that it is always only one segment or a small number of segments that is or are used to pick up the process liquid.

In brief, a process can therefore proceed as follows, for example:

- stoppage of cloth and rotation of the printing form;
- simultaneous activation of corresponding nozzles of the groups and pivoting of the groups (production of a meniscus in the nip);
- simultaneous deactivation of the nozzles and stoppage of the groups;
- production of a film on the rotating printing form;
- forward movement of the cloth; stoppage of the cloth;
- removal of the film from the rotating printing form; and
- forward movement of the cloth; stoppage of the cloth.

In order to produce a uniform film on the printing form, provision can also be made to dose the printing form repeatedly during one or more rotation or rotations (e.g. pre-dosing, dosing, post-dosing).

As an alternative to the embodiment described above, it is also possible with the apparatus 10 according to the invention or when carrying out the method according to the invention to vary the film thickness in the lateral or axial direction and/or in the circumferential direction with respect to the printing form, for example by driving the nozzle valves differently.

As an alternative to the symmetrical pivoting region illustrated in FIG. 3, provision can also be made, for example, for one half of the nozzle groups 6 (on a drive side AS of the machine) to be pivoted only between 0° and a maximum of about +30°, while the remaining half of the nozzle groups 6 (on the opposite, operator's side BS of the machine) are pivoted only between 0° and a maximum of about −30°. In this case, the pivoting angle regions are chosen in such a way that the jets of the process liquid 11 are always oriented toward the center of the machine (except when in the 0° position). In brief: the nozzles disposed on the left preferably emit toward the right and those disposed on the right preferably emit toward the left. This advantageously achieves a situation where, at the edge of the printing form 3 to be treated, only the desired quantity of process liquid 11 is applied and, in particular, disruptive droplets can be avoided. Since the process liquid 11 in the meniscus 16 is to some extent pushed in front of the jets, the nonsymmetrical pivoting movement described also achieves a situation where the process liquid at the lateral edge of the apparatus 10 does not travel undesirably far toward the outside, possibly beyond the edge. Also alternatively, but with the same advantage, provision can be made for only the two (outer) nozzle groups 6 disposed at the lateral edge to be pivoted between 0° and a maximum of about +30° and, respectively, between 0° and a maximum of about −30°, while the (inner) nozzle groups 6 disposed between them are all pivoted symmetrically between a maximum of about +30° and a maximum of about −30°. The statement of the limiting angle magnitude of 30° in this case corresponds to the preferred embodiment. However, larger magnitudes up to about 45° or beyond this are also possible.

Figure 4A:
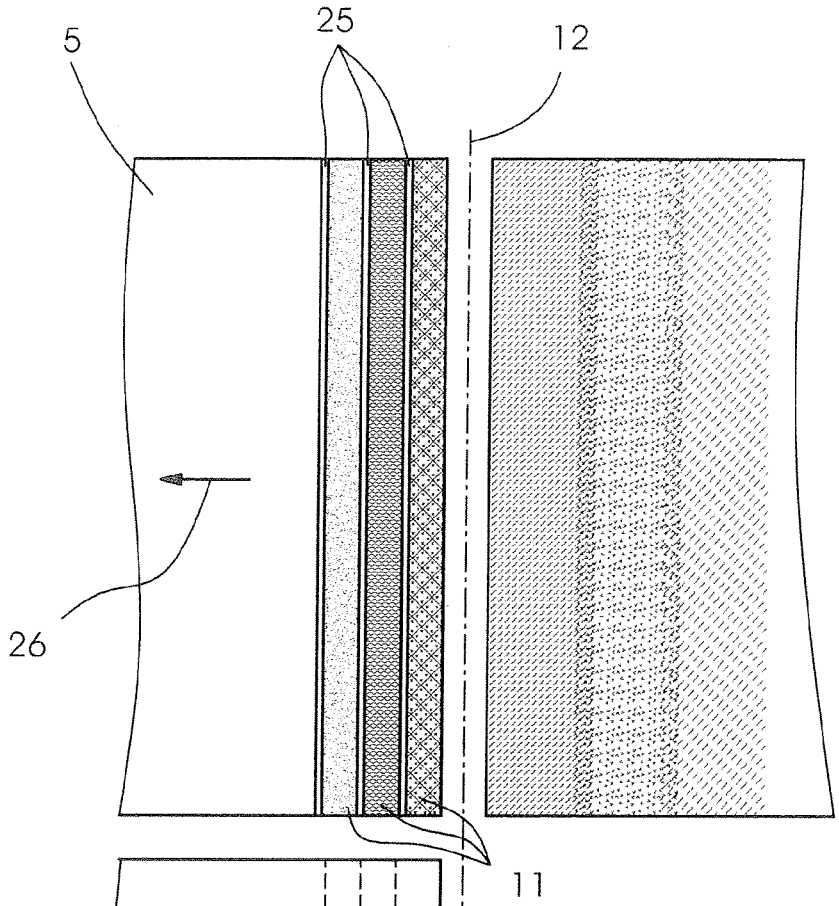
FIGS. 4A and 4B are fragmentary, plan views of segmented cloths for use in the apparatus according to the invention as compared with the prior art.

FIG. 4A shows a cloth 5, for example a nonwoven (in particular a microfiber nonwoven), which has segmented portions 25 provided substantially parallel to the axis of rotation 12. The cloth 5 has, for example, a width of the segmented portions of about 0.1 mm to about 5 mm (preferably about 1 mm) and a width of intermediate regions (segments) of about 0.5 mm to about 10 mm (preferably about 3 mm). The process liquid 11 which reaches the cloth 5 directly or reaches the cloth 5 indirectly through the surface of the printing form 3 or the meniscus 16 is not able to spread without hindrance in the cloth parallel to a feed direction 26 of the cloth. Instead, its spread is substantially limited by the segmented portions 25 which are provided. In FIG. 4A it is therefore possible to see that various process liquids 11 which have been used during the treatment of the printing technology surface are accommodated in the cloth sections between the segmented portions 25, for example cleaning liquid, liquid for coating or molecular covering of the surface of the printing form, or rinsing liquid. As a result of the provision of the segmented portions 25, the consumption of cloth per process liquid or process step, and thus also the consumption of cloth overall, can be reduced considerably. However, this reduction in the consumption of cloth also assumes that the process liquids 11 are discharged specifically, at the desired metering rate, at the desired point and as quickly as possible and with high dynamics. As a consequence of the cloth feed and the blocking action of the segmented portions, the liquids picked up by the cloth in the segments are advantageously not dragged into the following processes. For instance, if, as proposed in the prior art, spray nozzles were to be used, then under certain circumstances the spray mist could not also be prevented from being deposited in adjacent cloth sections between the segmented portions 25 and in this way soiling the cloth. On the right-hand side in FIG. 4A, it is therefore illustrated that a non-segmented cloth would have a significantly higher consumption of cloth and also a significantly greater intermingling of the processed process liquids.

Figure 5A:
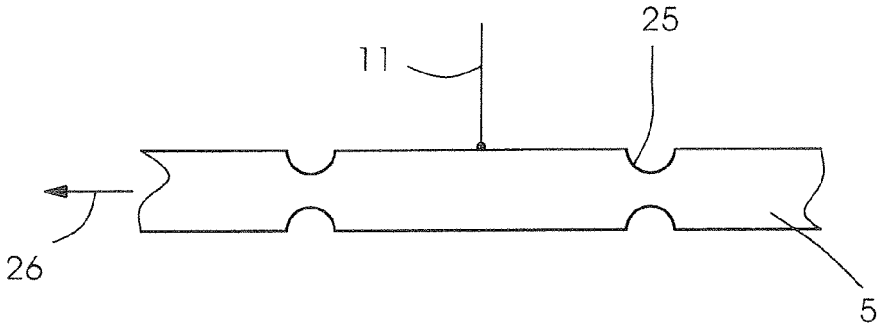
FIGS. 5A, 5B and 5C are fragmentary, sectional views of various segmented cloths for use in the apparatus according to the invention.
Figure 5B:
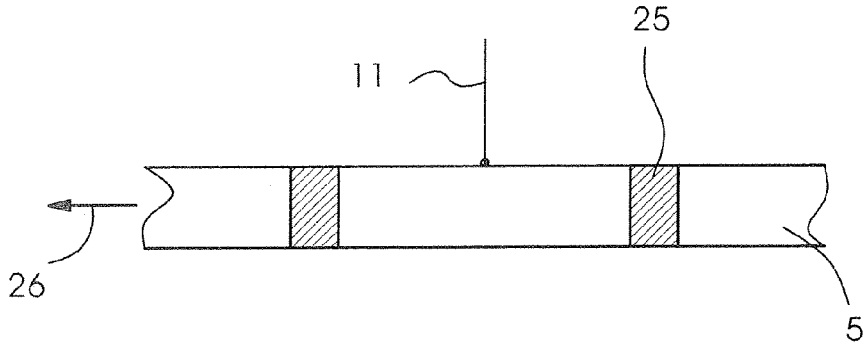
Figure 5C:
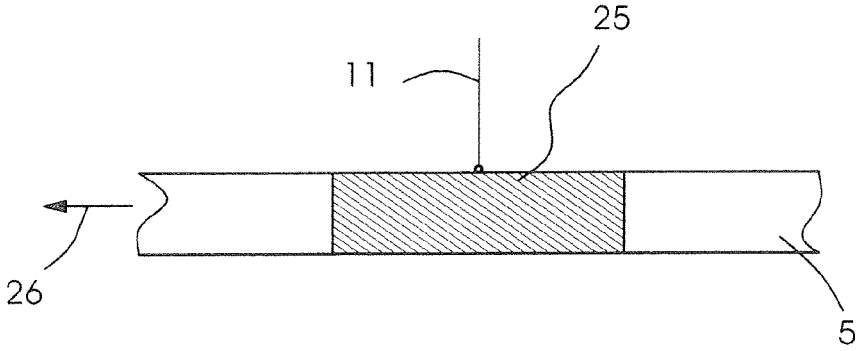

The segmented portions 25 are preferably introduced into the cloth as calendered portions, but other types of segmentation are also possible (see FIGS. 5A-5C). It is preferable that before each process step, a clean section of cloth is made available by a feed movement of the cloth. If the cloth is very finely subdivided into cloth sections by the segmentation, provision can also be made for a plurality of cloth sections to be used per process step (then, either a plurality of segments is spooled forward in advance or, during the processing, a segment is spooled forward again and again as a function of consumption).

Figure 4B:
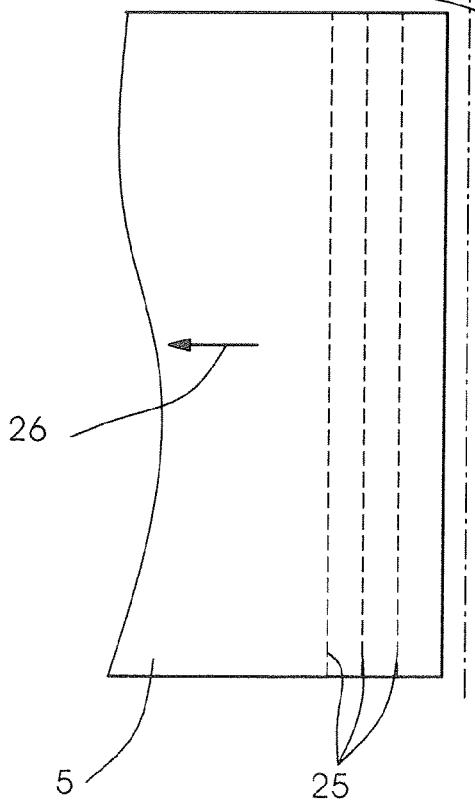

FIG. 4B also shows that the segmented portions running substantially parallel to the axis of rotation 12 do not have to be provided in an uninterrupted manner but that, instead, patterns, such as calendered or embossed lines running parallel to the axis of rotation 12, can also be provided.

It can be gathered from the illustration of FIGS. 5A, 5B and 5C that there are various possible ways of providing the cloth 5 with segmented portions 25. For instance, FIG. 5A shows a preferred embodiment in which the cloth 5 is provided with calendered portions 25 running substantially parallel to the axis of rotation, which compact the fibers of the cloth in the region of the segmented portion 25 in such a way that a spread of process liquid 12 in the cloth parallel to the feed direction 26 is substantially limited. On the other hand, FIG. 5B shows that the segmented portions 25 can also be implemented in another way in the cloth 5, for example by introducing a plastic that is liquid, cures at ambient temperature and forms a barrier for the process liquid 11 in the feed direction 26 of the cloth 5. Furthermore, according to FIG. 5C, provision can also be made to treat the cloth 5 with a medium which binds the process liquid applied and prevents a spread of the process liquid, so that a segmented portion 25 is made possible by the provision of the medium. Consequently, when various process liquids are processed, various bonding media are introduced into the cloth segment by segment.

The apparatus 10 according to the invention consequently permits the processing of printing technology surfaces 3 with a series of, in particular, more than two different process liquids, with it being possible for the consumption both of the liquids and of the cloth 5 to be kept low. The advantages according to the invention are therefore achieved, in particular, by the components including the nozzle device and the cloth device, which are coordinated with one another and operated in a mutually coordinated manner. On the other hand, during the intended processing of printing technology surfaces with a series of, in particular, more than two different process liquids, the use of spray nozzles and unsegmented cloths in accordance with the prior art would allow an increased consumption of liquid and cloth to be expected.

The invention claimed is:

1. An apparatus for treating a re-imageable printing form having an axis of rotation by using a process liquid, the apparatus comprising:

storage containers for receiving various process liquids;

supply lines each being connected to a respective one of said storage containers;

a plurality of jet nozzles disposed along a straight line substantially parallel to the axis of rotation of the printing form, said jet nozzles each being connected to a respective one of said supply lines, said jet nozzles being disposed along said straight line in a pivotable configuration of nozzle groups, said jet nozzles each being pivotable about a pivot axis substantially perpendicular to the axis of rotation and said nozzle groups having individual nozzles to be pivoted together and to discharge the various process liquids from said respective supply lines; and a cloth device disposed substantially parallel to the axis of rotation.

2. The apparatus according to claim 1, wherein said nozzles are pivotable in coordination with each other.

3. The apparatus according to claim 1, wherein said nozzles of a respective nozzle group are aimed substantially at the same point.

4. The apparatus according to claim 1, wherein said cloth device has a cloth with segmented portions running substantially parallel to the axis of rotation.

5. The apparatus according to claim 4, wherein said cloth has calendered portions running substantially parallel to the axis of rotation.

6. A machine for processing printing material, comprising at least one apparatus according to claim 1.

7. A printing press, comprising at least one apparatus according to claim 1.

8. A sheet-processing rotary printing press for lithographic offset printing, comprising at least one apparatus according to claim 1.

9. A print finishing machine, comprising at least one apparatus according to claim 1.

10. A machine for treating printing forms, comprising at least one apparatus according to claim 1.

11. A printing plate exposer, comprising at least one apparatus according to claim 1.

12. A method for treating a re-imageable printing form having an axis of rotation by using a process liquid, the method comprising the following steps:

providing storage containers for receiving various process liquids;

providing supply lines each being connected to a respective one of the storage containers;

providing a plurality of jet nozzles disposed along a straight line substantially parallel to the axis of rotation in a pivotable configuration of nozzle groups, the jet nozzles each being connected to a respective one of the supply lines and the nozzle groups having individual jet nozzles to be pivoted together;

discharging the various process liquids from the respective supply lines with the jet nozzles;

pivoting each of the jet nozzles about a pivot axis substantially perpendicular to the axis of rotation; and at least partly picking up the process liquid with a cloth of a cloth device disposed substantially parallel to the axis of rotation.

13. The method according to claim 12, which further comprises producing a substantially uniform distribution of the process liquid parallel to the axis of rotation during the step of pivoting the jet nozzles.

14. The method according to claim 12, which further comprises metering the process liquid into a nip between the cloth and the printing technology surface.

15. A method for treating a re-imageable printing form having an axis of rotation by using a process liquid, the method comprising the following steps:

providing storage containers for receiving various process liquids;

providing supply lines each being connected to a respective one of the storage containers;

providing a plurality of jet nozzles disposed along a straight line substantially parallel to the axis of rotation in a pivotable configuration of nozzle groups, the jet nozzles each being connected to a respective one of the supply lines and the nozzle groups having individual nozzles to be pivoted together;

discharging the various process liquids from the respective supply lines with the jet nozzles;

providing a cloth device disposed substantially parallel to the axis of rotation and having a cloth with segmented portions substantially parallel to the axis of rotation;

at least partly picking up the process liquid with the cloth; and coordinating movement of the cloth device in a feed direction and segmentation of the cloth, to substantially limit a spread of the process liquid in the cloth parallel to the feed direction.

16. The method according to claim 15, which further comprises producing a substantially uniform distribution of the process liquid parallel to the axis of rotation, with the segmented portions.

* * * * *